United States Patent [19]

Dubach

[11] Patent Number: 4,722,449

[45] Date of Patent: Feb. 2, 1988

[54] CONTAINER CLOSURE WITH HINGED CAP AND SEAL PIERCING MEANS

[75] Inventor: Werner F. Dubach, Hubrain, Switzerland

[73] Assignee: Alfatechnic AG, Switzerland

[21] Appl. No.: 897,312

[22] Filed: Aug. 18, 1986

[30] Foreign Application Priority Data

Aug. 20, 1985 [CH] Switzerland ..... 3573/85

[51] Int. Cl.[4] ..... B65D 41/38

[52] U.S. Cl. ..... 215/235; 215/250; 215/253; 222/83

[58] Field of Search ..... 215/235, 250, 253, 256; 222/83

[56] References Cited

U.S. PATENT DOCUMENTS

| | | | |
|---|---|---|---|
| 3,650,428 | 3/1972 | Miller | 215/256 X |
| 4,046,276 | 9/1977 | Winchell et al. | 215/250 |
| 4,307,821 | 12/1981 | McIntosh | 215/256 X |
| 4,456,150 | 6/1984 | Yang | 222/83 |
| 4,487,324 | 12/1984 | Ostrowski | 215/253 |
| 4,545,497 | 10/1985 | Martha | 215/253 |

FOREIGN PATENT DOCUMENTS

| | | |
|---|---|---|
| 50490 | 4/1982 | European Pat. Off. . |
| 2456931 | 8/1976 | Fed. Rep. of Germany . |
| 2923379 | 4/1980 | Fed. Rep. of Germany . |
| 2904181 | 8/1980 | Fed. Rep. of Germany . |
| 2952778 | 7/1981 | Fed. Rep. of Germany . |
| 3202226 | 9/1982 | Fed. Rep. of Germany . |

*Primary Examiner*—Donald F. Norton

*Attorney, Agent, or Firm*—Thomas W. Speckman; Ann W. Speckman

[57] ABSTRACT

A container closure attachable directly or indirectly to a container neck sealed by means of a pierceable film seal. The provision of a film seal covering the container neck guarantees the user that the contents of the container are authentic and original as supplied by the manufacturer. The film seal is pierced as the closure is adjusted from an intact to an access position on the container neck. In the upper intact position, a safety band remains intact. The closure can be adjusted to the lower access position only after the safety band has been removed, and the film seal is pierced as the closure is adjusted to the lower access position. Ratchet-like serrations may be provided on the inner side of the safety band engaging the container, thus making it impossible to unscrew a screw-type closure without removing the safety band. The safety band may be provided on a separate intermediate piece which may be snap-fitted or screwed onto the container neck. Opening means for piercing the film seal may be provided on the intermediate piece.

20 Claims, 9 Drawing Figures

400
406
405
407
402
403
404
506

20
207
208
209
204
206
60
504
505

20
202
205
204
60
502
503

CONTAINER CLOSURE WITH HINGED CAP AND SEAL PIERCING MEANS

BACKGROUND OF THE INVENTION

1. Field of the Invention

The present invention relates to a closure suitable for attachment directly or indirectly to a container neck sealed by a pierceable membrane or film. The provision of a membrane or film sealing the open neck of the container guarantees the user that the contents of the container are authentic and original as supplied by the manufacturer. Furthermore, by insuring the exclusion of air from the contents, this film also helps to prevent oxidation of the product.

2. Description of the Prior Art

A simple form of closure is known, which is provided with a cap screwed onto the container neck, whereby a film covers the open neck of the container, which film can be pierced manually or with the help of a tool. Closures of this type provide no guarantee that the contents have not been tampered with unless the user takes the trouble to check the contents. For this purpose, the user has to unscrew the cap.

Screw closures which are protected against initial removal provide better protection for the user. Screw closures of this type are known. In order to prevent a cap of this type from coming unscrewed of its own accord, it is provided with a safety band which engages in ratchet-like serrations provided around the neck of the container. This arrangement insures that the screw cap cannot be removed without breaking the safety band. In fact, this cap cannot be unscrewed until the safety strip has first been torn off and removed. Arrangements of this type are described in German Patent Publications DE-A Nos. 24 56 931; 29 04 181; 29 23 379; 29 52 778; and 32 02 226, for example.

A further development of this type of arrangement is described in European Patent EU-PS No. 0050 490. Once the safety band has been removed the cap can be unscrewed, whereby it engages under the edge of an upper part of the container neck and can be snapped off. As soon as the cap is unscrewed for the first time, the part which snaps off is torn away from the container neck by rotating the cap.

All the prior art teachings for improving the safety of containers to insure that the contents are intact and have not been tampered with directly conflict with the objective of providing the required degree of user convenience. For the user to be able to make use of the contents of a container, the closure must first be unscrewed and then screwed back onto the container after use. There is also the risk of the cap being lost, so that the container can no longer be closed properly, thus allowing its contents to spoil or the quality to suffer.

SUMMARY OF THE INVENTION

A purpose of the present invention is to provide a closure for containers with contents protected against tampering by means of a membrane or film seal covering the open neck of the container. Such a closure must, moreover, be user-friendly and, instead of a simple screw cap, is provided with an opening for pouring which can be closed by a permanently attached hinged cap. This arrangement is convenient and the provision of detailed instructions for its use is unnecessary.

The present invention meets the above requirements in that it provides a closure suitable for attachment directly or indirectly to a container neck sealed by a pierceable film, the closure having a base with a spout opening, a hinged cover closing the spout opening, retaining means for maintaining the closure in an intact position relative to the sealing film, and a means for piercing the film sealing the container neck.

A closure of this type must be capable of adopting at least two positions: a higher position on the container neck, in which position the film or membrane seal remains sealed and intact; and a lower position on the container neck in which the film or membrane is pierced to provide access to the contents. These two positions will be henceforth referred to as the sealed or intact position and the access position, respectively.

The present invention provides several embodiments of this type of closure. In one embodiment, the closure is adjusted from its intact position to the access position by a rotational movement after the safety band has been removed. In another embodiment, the closure is moved from the intact position to the access position by axial displacement after the safety band has been removed.

BRIEF DESCRIPTION OF THE DRAWINGS

Embodiments of the present invention are illustrated in the attached drawings, wherein.

DESCRIPTION OF THE PREFERRED EMBODIMENTS

Figure 1B:
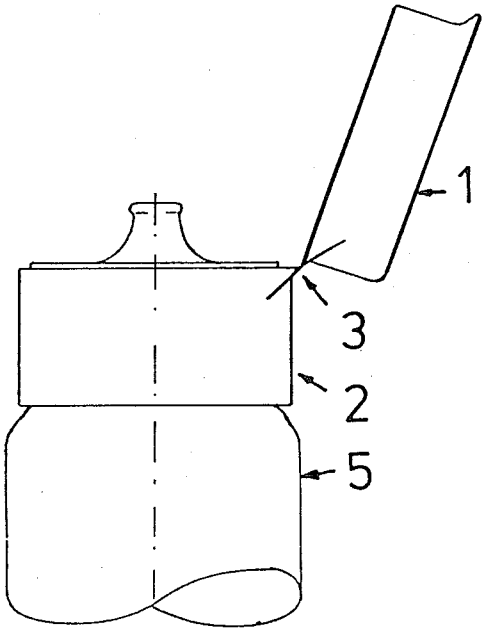
FIG. 1*b* is a side view of a closure according to FIG. 1*a* with an open cap.
Figure 1A:
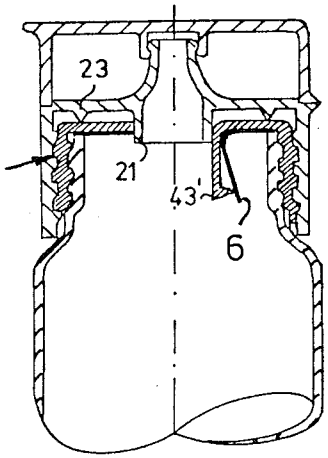
FIG. 1*a* is a cross-sectional view of the closure of FIG. 1 in the access position.
Figure 1:
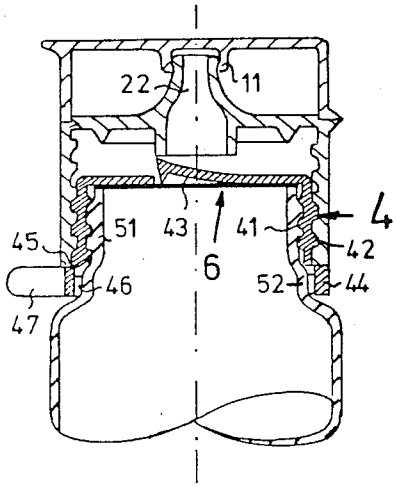
FIG. 1 is a cross-sectional side view of a closure in the intact position which can be adjusted to the access position by screwing.

FIGS. 1, 1*a*, and 1*b* show a screw-on type of closure with hinged plastic cap 1 and base 2 connected to one another by means of the usual type of film hinge 3. The closure itself is connected indirectly to container 5 by means of annular intermediate piece 4. This intermediate piece is provided with internal thread 41 as well as external thread 42. It is fastened to externally threaded container neck 51 by means of internal thread 41. The base of the closure itself is screwed to external thread 42 of the intermediate piece. Between the upper edge of container neck 51 and intermediate piece 4, film 6 is fastened, such as by sealing, welding or bonding, to the edge of container neck 51 and possibly to intermediate piece 4 as well. Intermediate piece 4 is provided with opening means 43 which is located above film 6 and does not penetrate the film when the closure is in the intact position according to FIG. 1. When the closure is moved from the intact position to the access position shown in FIG. 1*a*, the extent to which the container is opened is determined by the displacement of hollow rammer 21 and opening means 43 is moved to position 43' shown in FIG. 1*a*, in which film 6 is broken open and pushed aside.

As mentioned above, base 2 is provided with hollow rammer 21 adjacent to spout opening 22. In the access position shown in FIG. 1*a*, annular projection 23 bears on intermediate piece 4 and determines the exact position of the closure relative to the intermediate piece. Cap 1 is provided with sealing ring 11 which seals with spout opening 22 when the cap is closed.

To insure that the closure cannot be accidentally moved from the intact position (FIG. 1) to the access position (FIG. 1*a*), the intermediate piece may be provided with safety band 44 to which it is connected by weak seam 45 which is designed to be torn. The inner side of the safety band is provided with ratchet-like serrations 46 which engage in matching teeth 52 provided around the lower part of the container neck. This arrangement prevents the closure from unscrewing from its intact position.

Safety band 44 may be provided with grip strip 47 by which it can be torn from the intermediate piece. The closure cannot be unscrewed from its intact position and advanced from the intact to the access position until the safety band has been torn away.

Figure 2B:
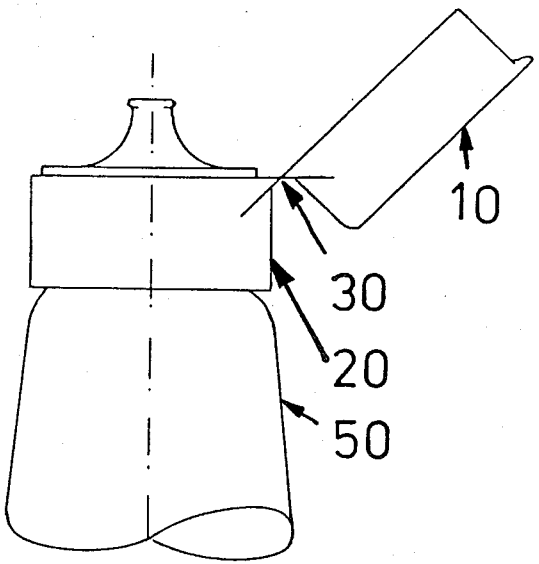
FIG. 2*b* is a side view of a closure according to FIG. 2*a* with an open cap.
Figure 2A:
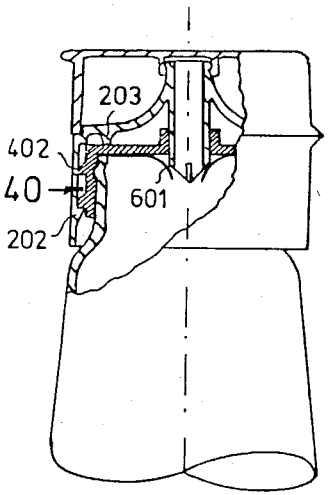
FIG. 2*a* is a partially cross-sectional view of the closure of FIG. 2 in the access position.
Figure 2:
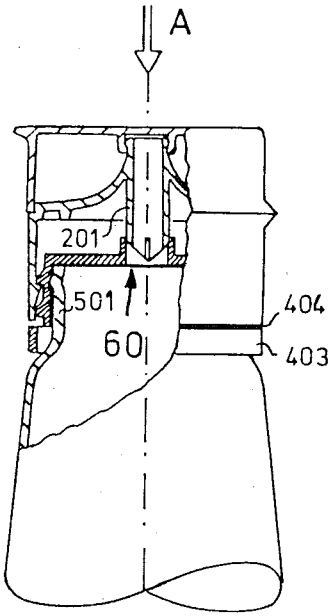
FIG. 2 is a partially cross-sectional side view of a closure in the intact position which can be adjusted to the access position by axial displacement.

FIGS. 2, 2*a* and 2*b* show a similar type of closure which differs from the closure according to FIG. 1 in that it is moved from its intact position shown in FIG. 2 to the access position shown in FIG. 2*a* by sliding or displacing it axially downward. Another difference between these two embodiments is that film seal 60 is pierced by hollow prong 201 which penetrates a central opening in the intermediate piece and arrives at position 601 shown in FIG. 2*a*. Intermediate piece 40 is not screwed onto container neck 501 but is snapped in place instead. The outer side of the intermediate piece is not threaded, but is provided with a pair of parallel retaining rings 402, as shown on a larger scale in FIG. 5. The distance between these two rings defines the displacement between the intact position and the access position. Retaining tabs 202 may be provided on the inner side of base 20 (see also FIG. 3), which are engageable below the upper or the lower ring, depending on the position of the closure comprising cap 10, base 20 and hinge 30. In order to positively locate the closure in its intact position, intermediate piece 40 may also be provided with safety band 403 to which it is connected by means of weak seam 404. Unlike the safety band according to FIG. 1, provision of ratchet-like serrations to prevent rotational displacement is not necessary in this case. Although it is possible to rotate the closure in its intact position, it cannot be removed from the container by rotation. If the portion of the container adjacent the container neck is of a suitable configuration (as shown in FIG. 2), as the closure is advanced to its access position, the safety band will be snapped off automatically. The safety band could alternatively be provided with a grip strip.

The closure according to FIG. 2 can thus be adjusted from its intact position shown in FIG. 2 in the direction of arrow A to its access position shown in FIG. 2*a* by application of pressure. For this purpose, it suffices to knock or push the closure in an axial, downward direction. As a result, safety band 403 will tear off of its own accord and retaining tabs 202, which previously were engaged under upper ring 402, will now engage under lower ring 402. Annular projection 203 on the lower side of base 20 of the closure serves as a stop in this arrangement.

Figures 3, 4, 5:
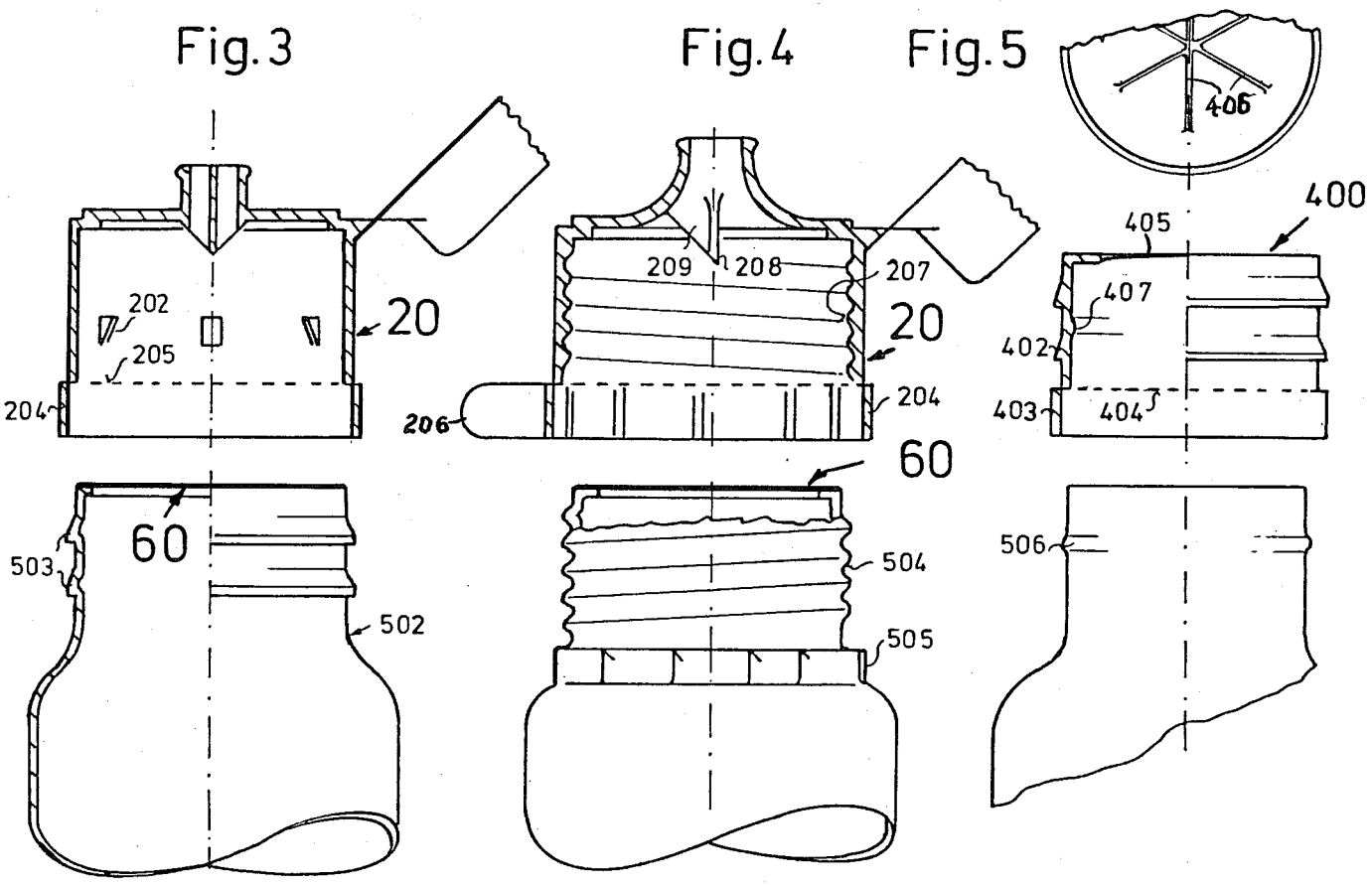
FIG. 3 is a partially cross-sectional side view of a closure similar to FIG. 2 and a container neck of matching configuration.
FIG. 4 is a partial cross-sectional side view of a screw closure and a container neck provided with screw threads and ratchet-like serrations.
FIG. 5 is a partial cross-sectional side view of an intermediate piece and a container neck shaped so that the intermediate piece can be pressed or snapped in place over the neck.

FIGS. 3–5 show additional embodiments of the present invention.

FIG. 3 shows parallel retention rings 503 formed directly on container neck 502. Film 60 is provided sealing with the upper edge of the container neck to protect the container contents against tampering. Provision of a separate intermediate piece is unnecessary in this arrangement. However, this arrangement does require that safety band 204 be provided on base 20 of the closure. Safety band 204 is connected to the lower edge of base 20 of the closure by means of tear seam 205. The remainder of this arrangement correponds to the arrangement and functional description provided for FIGS. 2, 2*a* and 2*b*.

FIG. 4 shows a screw-type closure. The container neck is provided with external thread 504 and ratchet-like serrations 505 adjacent to it. The upper edge of the container neck is provided with sealing membrane 60 bonded or joined to it. The lower edge of base 20 of the closure is provided with safety band 204 with tear tab 206.

Base 20 of the closure is provided with internal thread 207 which matches external thread 504 on the container neck. A cutter with sharp point 208 and angular edge 209 is provided on the internal side of base 20 of the closure facing the container neck, whereby this sharp point acts like a plowshare. When the closure is screwed to achieve the access position after removal of the safety band, sharp point 208 initally cuts the membrane, and after reaching a certain depth it no longer cuts, at which point angular edge 209 presses the partially severed portion of membrane 60 inwards. There is, therefore, no risk of any loose part of the sealing membrane dropping into the container.

FIG. 5 shows intermediate piece 400 which can be properly sized to replace intermediate piece 40 according to FIG. 2. However, intermediate piece 400 differs in that an upper part of intermediate piece 400 in this embodiment is made thin enough for it to replace the separate film seal, and thus a portion of the intermediate piece itself constitutes pierceble membrane 405. In addition, this membrane may be provided with weakened tear lines 406 arranged in the form of a star. The container neck may be provided with annular projection 506 to insure that the closure is positively fastened on the container neck by annular projection 407 provided on the internal wall of intermediate piece 400.

For the sake of greater clarity, safety means which prevent cap 1 or 10 from opening as long as the closure is still in its intact position, have been omitted from the drawings. It should be noted however that in the absence of these means, it would be possible to open the cap and to piece the sealing film or membrane through the spout opening.

A safety means of this type may take the form of an additional safety band but this solution would be complicated. A solution to this problem is provided in copending Swiss Patent Application Ser. No. 3563/85-0, filed Aug. 19, 1985, which describes a catch formed on the cap itself which locks the cap in the intact position and automatically separates from the base of the closure when it is advanced to the access position.

I claim:

1. A container closure made of plastic material attachable to a container neck sealed by a pierceable film seal, said closure comprising: a base having a spout opening, a cap connected to said base by a hinge and engageable with said base to close said spout opening, means for piercing the pierceable film seal adjacent and extending downwardly from said spout opening, fastening means for attaching said base to the container neck, and a removable retaining means attached to a lower edge of said base for limiting axial displacement of said closure, whereby said closure is maintainable in an intact position on an upper portion of said container neck by said retaining means and is adjustable to an access position on a lower portion of said container neck upon removal of said retaining means;

2. A container closure according to claim 1 attached to a container neck, wherein said container neck has external screw threads and ratchet-like serrations adjacent and below said external screw threads; said base has internal screw threads engaged with said external screw threads on said container neck providing said fastening means; said closure is adjustable from said intact position to said access position by rotating said base with respect to said container neck; and said removable retaining means has ratchet-like serrations engaged with said ratchet-like serrations on said container neck when said closure is in said intact position, whereby said closure cannot be unscrewed when said retaining means is connected to said base of said closure.

3. A container closure according to claim 1 attached to a container neck, wherein parallel upper and lower retention rings are provided on an outer surface of said container neck and parallel upper and lower retention rings are provided on an inner surface of said base, and said closure is maintainable in said intact position when said lower retention ring on said base is between said upper and lower retention rings on said container neck and in said access position when said upper retention ring on said base is between said upper and lower retention rings on said container neck; said retaining means comprises a removable safety band maintaining said closure in said intact position; and interaction of said retention rings provides adjustment of said closure between said intact and access positions by permitting limited axial displacement of said closure with respect to said container neck and prevents removal of said closure from said container neck.

4. A container closure according to claim 1 attached to a container neck, wherein said pierceable film seal is attached to and forms a seal across the opening of said container neck.

5. A container closure according to claim 1, wherein said opening means for piercing film seal comprises an angular edge terminating at a sharp point adjacent and extending downwardly from said spout opening.

6. A container closure according to claim 1, wherein said base has an internal screw thread providing said fastening means, and said removable retaining means has ratchet-like serrations.

7. A container closure according to claim 1, wherein parallel upper and lower retention rings are provided on an inner surface of said base and comprise said fastening means.

8. A container closure made of plastic material attachable to a container neck sealed by a pierceable film seal, and closure comprising: a base having a spout opening and a cap connected to said base by a hinge and engageable with said base to close said spout opening; an intermediate part mountable between an inner surface of said base and an outer surface of the container neck; an opening means for piercing said pierceable film seal; and a removable retaining means for limiting axial displacement of said closure mounted below said intermediate part and said base, whereby said closure is maintainable in an intact position on an upper portion of said container neck by said retaining means and is adjustable to an access position on a lower portion of said container neck upon removal of said retaining means.

9. A container closure according to claim 8, wherein said pierceable film seal comprises a membrane formed in one piece with said intermedite piece (400).

10. A container closure according to claim 9, wherein said membrane of said intermediate piece is provided with weakened tear lines.

11. A container closure according to claim 8, wherein said pierceable film seal is attached to and forms a seal across the opening of said intermediate piece.

12. A container closure according to claim 8, wherein said opening means for piercing said film seal comprises a hollow prong adjacent and extending downwardly from said spout opening.

13. A container closure according to claim 12, wherein a central opening is provided in said intermediate piece aligned with said hollow prong, and said central opening has a diameter corresponding to the diameter of said hollow prong.

14. A container closure according to claim 8 attached to a container neck, wherein said pierceable film seal is attached to and forms a seal across the opening of said container neck; said opening means is provided on said intermediate part (4); and a hollow rammer is provided on said base adjacent and below said spout opening and aligned with said opening means, whereby axial displacement of said base with respect to said container neck causes said hollow rammer to displace said opening means and thereby pierce said film seal.

15. A container closure according to claim 8, wherein said removable retaining means is attached to a lower edge of said intermediate part.

16. A container closure according to claim 8 wherein said base has internal screw threads and said intermediate part has internal screw threads engageable with the container neck and external screw threads engageable with said internal screw threads on said base, whereby said closure is adjustable from said intact position to said access position upon removal of said retaining means and rotation of said base with respect to said intermediate part.

17. A container closure according to claim 16, wherein said removable retaining means has ratchet-like serrations.

18. A container closure according to claim 8 attached to a container neck, wherein said container neck has external screw threads and ratchet-like serrations adjacent and below said external screw threads; said base has internal screw threads; said intermediate part has internal screw threads engaged with said external screw threads on said container neck and external screw threads engaged with said internal screw threads on said base; and said removable retaining means has ratchet-like serrations engaged with said ratchet-like serrations on said container neck, whereby said closure is adjustable from said intact position to said access position upon removal of said retaining means and rotation of said base with respect to said intermediate part.

19. A closure according to claim 8 wherein an outer surface of said intermediate part is provided with parallel upper and lower retention rings and an inner surface of said base is provided with parallel upper and lower retaining tabs corresponding to said parallel retention rings; and interaction of said retention rings with said retaining tabs provides adjustment of said closure between said intact position and said access position by permitting limited axial displacement of said base with respect to said intermediate part.

20. A container closure according to claim 8 attached to a container neck, wherein an outer surface of said container neck and an inner surface of said intermediate part are provided with complementary fastening means and said intermediate part is mounted on said container neck; parallel upper and lower retention rings are provided on an outer surface of said intermediate part and parallel upper and lower retaining tabs are provided on an inner surface of said base, whereby said closure is maintainable in said intact position when said lower retaining tab is between said upper and lower retention rings and in said access position when said upper retaining tab is between said upper and lower retention rings; said retaining means comprises a removable safety band maintaining said closure in said intact position; and said interaction of said retention rings and said retaining tabs provides adjustment of said closure between said intact and access positions by permitting limited axial displacement of said closure with respect to said intermediate part and prevents removal of said closure from said intermediate part.

* * * * *